United States Patent [19]

Urban

[11] 3,955,496

[45] May 11, 1976

[54] LINEAR CAN PRINTER

[75] Inventor: Joseph J. Urban, Pleasantville, N.Y.

[73] Assignee: Crown Cork & Seal Company, Inc., Philadelphia, Pa.

[22] Filed: Sept. 17, 1974

[21] Appl. No.: 506,907

[52] U.S. Cl. ..... 101/40; 74/243 C; 74/245 C; 101/218; 101/407 A

[51] Int. Cl.[2] ..... B41F 17/22

[58] Field of Search..... 101/40, 39, 218, 407 R, 101/407 A; 74/243 C, 245 C

[56] References Cited

UNITED STATES PATENTS

| | | | |
|---|---|---|---|
| 1,814,806 | 7/1931 | Hormel | 101/218 X |
| 2,132,818 | 10/1938 | Cone | 101/40 X |
| 2,244,592 | 6/1941 | Youngs | 101/40 |
| 2,703,047 | 3/1955 | Scherer et al. | 101/40 X |
| 3,356,019 | 12/1967 | Zurick | 101/39 |
| 3,362,520 | 1/1968 | Rudolph et al. | 101/39 X |
| 3,564,998 | 2/1971 | Johnson | 101/40 |
| 3,683,799 | 8/1972 | Szpitalack | 101/40 |
| 3,783,777 | 1/1974 | Killen et al. | 101/40 |
| 3,806,140 | 4/1974 | Robertson | 101/407 R X |

*Primary Examiner*—Anton O. Oechsle
*Attorney, Agent, or Firm*—Woodcock Washburn Kurtz & Mackiewicz

[57] ABSTRACT

A linear conveyor has a plurality of mandrels on which cans are held for movement between a feed station and a discharge station. A plurality of printers are longitudinally spaced between the feed and discharge stations. Printing cylinders are rotated in synchronism with the can mandrels so that exact registration of different printing patterns is obtained. A compensated conveyor produces no slack in the conveyor chain so that the conveyor moves at a constant velocity without the jerky motion which would otherwise cause misregistration of the printing patterns.

17 Claims, 19 Drawing Figures

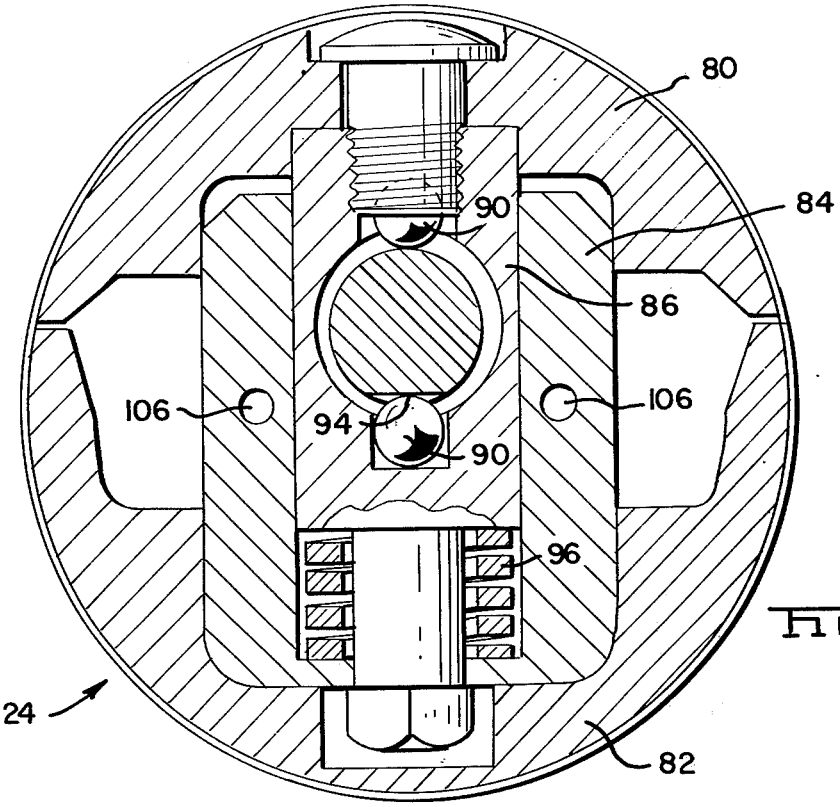
Fig. 13
Fig. 14
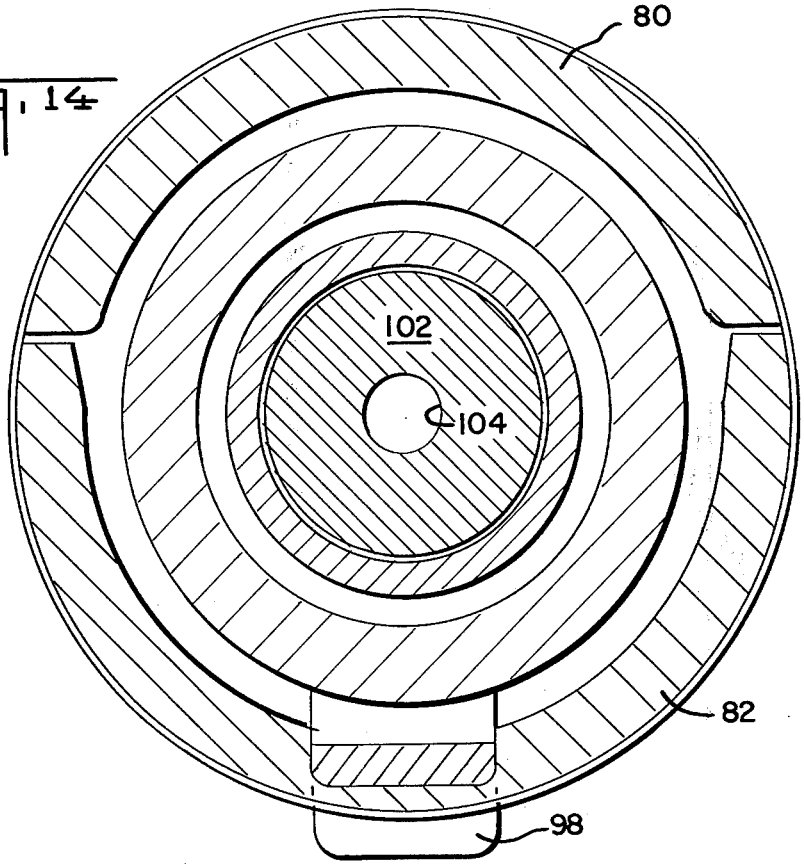

122
110
118
120
116
60
56
54
114
112
58
24
36
38

LINEAR CAN PRINTER

BACKGROUND OF THE INVENTION

This invention relates to apparatus for printing patterns on cans and similar cylindrical objects and more particularly to a can printer having a linear conveyor with the printing stations spaced longitudinally along the linear conveyor.

Recently, rotary can printers have been extensively used for printing patterns on cans. A typical rotary printer has a plurality of mandrels on a mandrel drum. The mandrels carry the cans into contact with a rotating printing blanket. Examples of such rotary can printers are shown in U.S. Pat. Nos. 3,587,816 - Russell et al and 3,496,863 - Cvacho et al.

It is often desirable to print a multiple colored pattern on a can. In this case, the different colors are printed at different printing stations. Usually, it is desirable that each color be at least partially dried before the next color is printed in the pattern. Rotary can printers are not suitable for this because there is not sufficient room between printing positions to allow drying, or if large distance is allowed, then the drum would be of an inconveniently large diameter.

Another problem with rotary can printers is that the printing stations are crowded around the periphery of the drum and access to them is difficult. It is quite difficult to remove one printing station without completely disrupting the operation of the printer.

Linear conveyors are extensively used in can handling. U.S. Pat. No. 2,718,847 - Jackson et al shows a linear conveyor carrying bottles past a printer. However, the printer is of the rotary type in which the patterns to be printed are impressed upon a rotating printing blanket which contacts the bottles. This type of printer suffers from the same disadvantages discussed above with respect to rotary printers.

One reason for the apparent lack of use of linear conveyor printers in the prior art is the problem of obtaining good registration between the can pattern and printing blanket. Prior art linear conveyors have not provided the precise timing and registration necessary for a multiple printing operation.

Another reason that linear conveyors have not been used in can printers is that a conveyor chain normally produces a jerky motion. The standard type of drive chain used in conveyors must, of necessity, be allowed a certain amount of slack for proper functioning and wear. Slack between the chain link and the sprocket is inherent in normal conveyors and it causes the chain to move at changing speeds. Because of this, such prior art conveyors do not have the accuracy required to maintain precise registration of a printing mandrel with a printer.

SUMMARY OF THE INVENTION

In accordance with this invention, a printer for cans and similar cylindrical objects includes a linear conveyor which moves these objects between a feed station and a discharge station. A plurality of printing mechanisms are spaced longitudinally along the linear conveyor to provide room for each different color pattern to dry before the printing of the next pattern and to provide easy access to each of the printing stations. A compensated conveyor provides a constant velocity of the cans past the printing mechanisms.

In accordance with another aspect of this invention, can carrying mandrels on the conveyor are continuously rotated in synchronism with the rotation of the printing cylinders so that correct registration of a printing pattern on the cans is achieved without slippage between the can and the printing cylinder which might otherwise cause smudging of the pattern.

In accordance with another feature of this invention, the continuous rotation of the mandrels between printing stations aids the drying of the printed patterns.

In accordance with another feature of this invention, a novel and useful compensating link is provided in the linear conveyor.

In accordance with another feature of the invention, each of the mandrels is expandible into gripping relationship with the cans.

The foregoing and other objects, features and advantages of the invention will be better understood from the following more detailed description and appended claims.

DESCRIPTION OF THE DRAWINGS

FIGS. 3A, 3B combined form a front elevation of the machine shown in FIG. 1;

FIG. 13 is a view taken along the lines 13—13 of FIG. 12;

FIG. 14 is a view taken along the lines 14—14 of FIG. 12;

BRIEF DESCRIPTION OF THE PREFERRED EMBODIMENT

Figure 1:
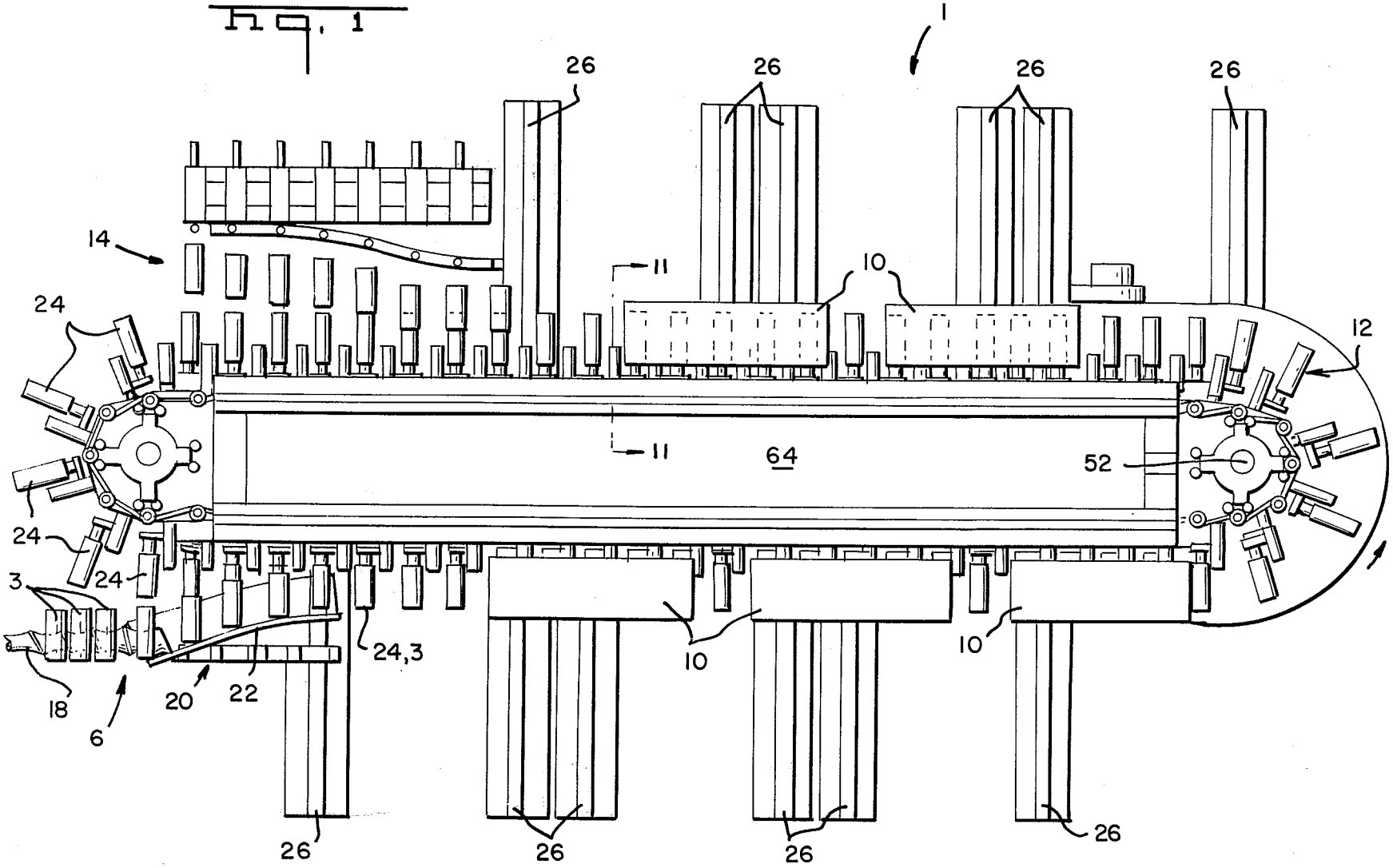
FIG. 1 is a partially diagrammatic top plan view of a machine embodying the principles of this invention.
Figure 2:
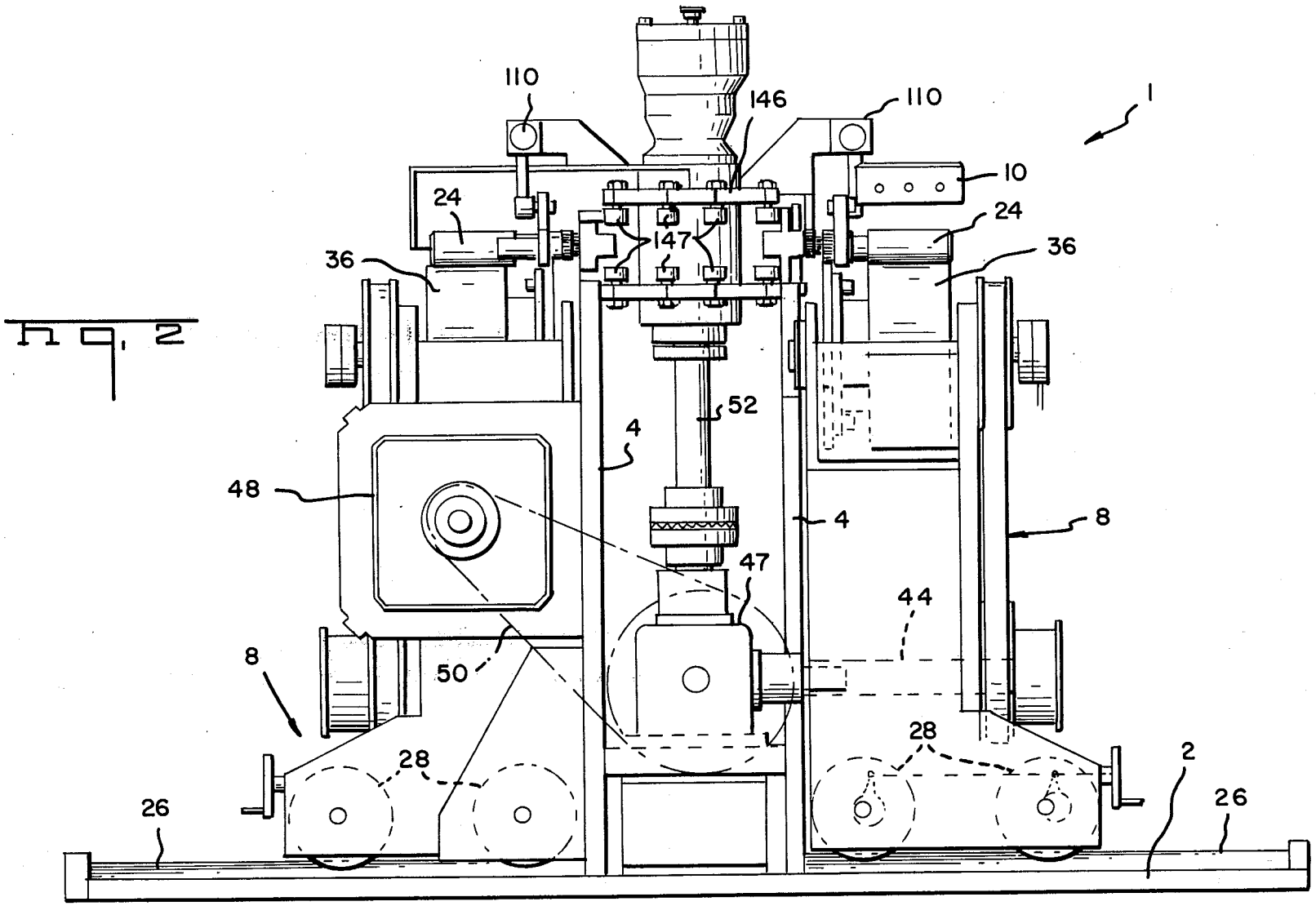
FIG. 2 is an end view of the machine shown in FIG. 1.
Figure 1:
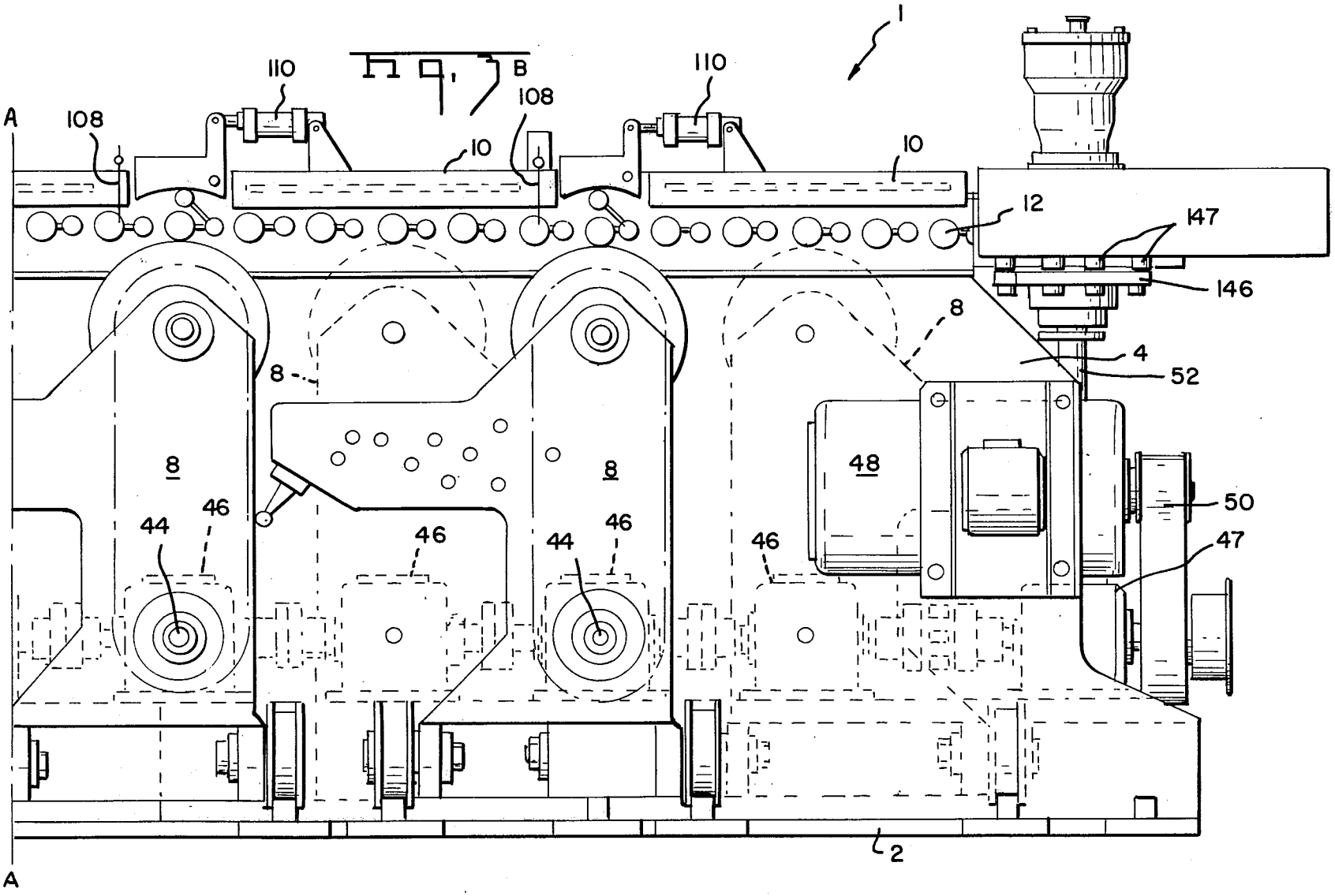
Figure 1:
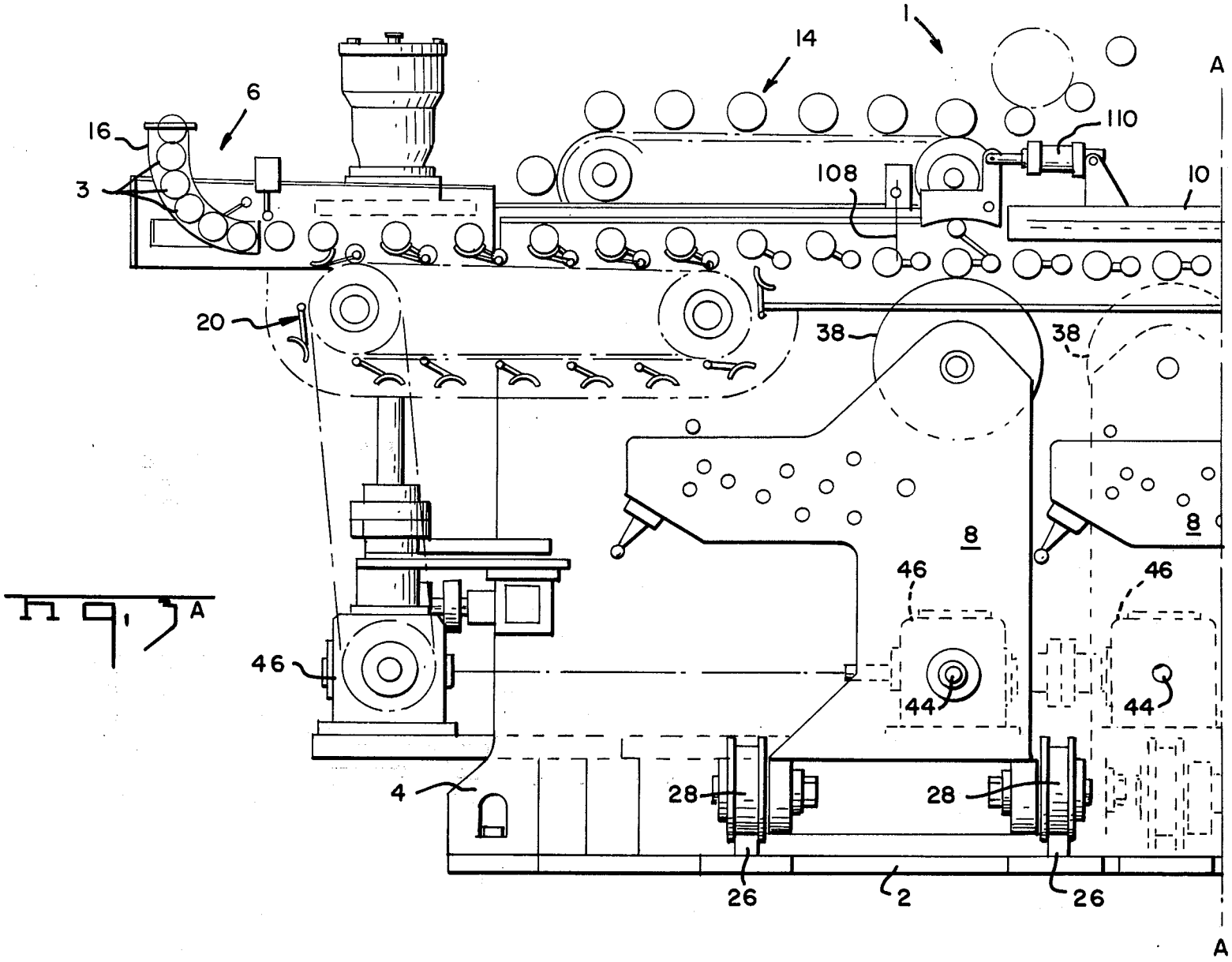

As shown in FIGS. 1, 2 and 3, the disclosed printing machine 1 comprises a base 2, a frame 4, a can feeding station 6, a plurality of printers 8, a plurality of drying ovens 10, a constant velocity linear conveyor 12 and a can discharge station 14.

Cans 3 to be printed are fed to the machine via a gravity fed chute 16 where they are then introduced to a separting and spacing screw 18 after which they are picked up by a can insertion conveyor 20 (FIG. 3). Conveyor 20, coupled with a cam track 22, then progressively inserts the cans 3 onto each successive mandrel 24 as they pass in timed sequence. As the constant velocity mandrel carrying conveyor 12 advances in a counter-clockwise movement as viewed in FIG. 1, each mandrel 24, with a can 3 is presented to one or more printing and drying stations until the finished can is finally ejected at discharge station 14.

Between each printing station, a drying oven 10 containing ultraviolet lights or other drying means conditions the can for the next printing station. The disclosed machine contains five printing and five drying stations, but any reasonable number of stations may be used simply by lengthening or shortening the frame and conveyor mechanism.

The printers 8 have wheels 28 which are set on tracks 26 for movement on the base 2. This provides easy engagement and disengagement of the printers with the conveyors. This enables the machine to be preset for a variety of labels to be printed. For example, the first two printers may be set up for a label containing two colors and the latter three printers for a label containing three colors. When it is desired to print the two color label, the last three printers would be moved away from the conveyor 12 via tracks 26 and wheels 28 whereby they would not be in a printing position. Only the first two printers would be used and the finished cans would be ejected at station 14. When it is desired to print the three color label, the first two printers would be disengaged from the conveyor and the last three would be engaged with the conveyor, thereby giving the machine useful flexibility.

Figure 4:
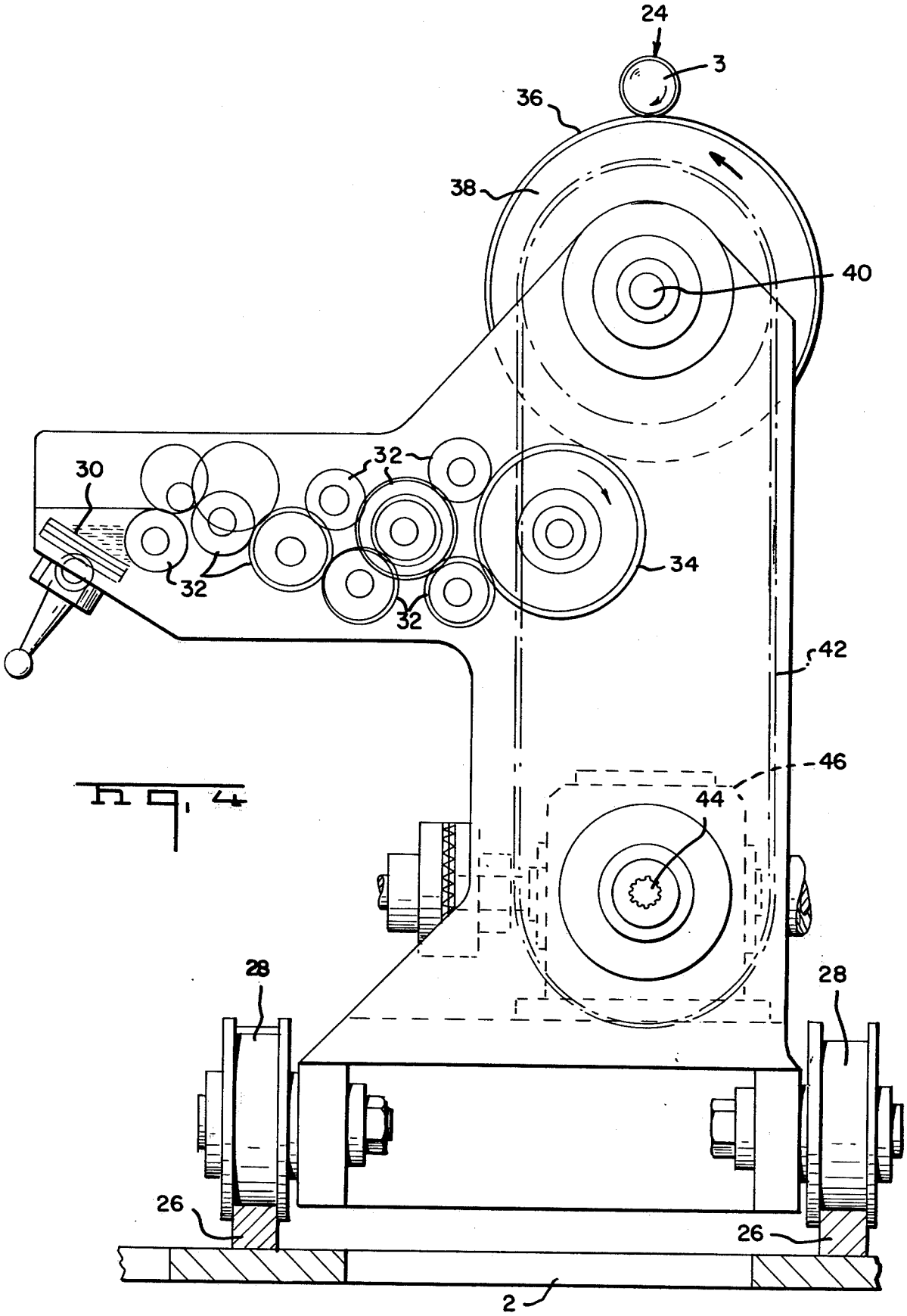
FIG. 4 is a front elevation view of a typical printing mechanism for the disclosed device.

Referring to FIG. 4, each printer 8 is of the standard off-set type wherein the ink is supplied from ink fountain 30, and is transmitted through a series of rollers 32 to a plate roller 34 and then to a printing cylinder. It will be recognized that a gravure printer or a combination of known printers could be used. The printer which is shown comprises a printing blanket 36 on a drum 38 fixed for rotation on a shaft 40. Shaft 40 is driven by a timing belt 42 connected to a sprocket fixed on the splined shaft 44 of a rectangular drive 46. Each printing mechanism and the loading and unloading conveyors are driven off individual rectangular drives 46, all commonly joined to a first rectangular drive 47 (FIG. 3B) which is driven by a motor 48 through a timing belt 50. Rectangular drive 47, through a right angle drive, also drives a vertical shaft 52 which as viewed in FIG. 15 causes the rotational movement of conveyor 12.

As the cans are presented to each successive printing station, they must be in perfect registration or the succeeding print will over-print, overlap or otherwise misprint and the label will be ruined. Each can must meet the successive printers at a precise point so the different colors of print will be placed in their proper relative positions to create the desired label. This demanded feature precludes permitting the cans to "free wheel" as they are met by the printer.

Figure 5:
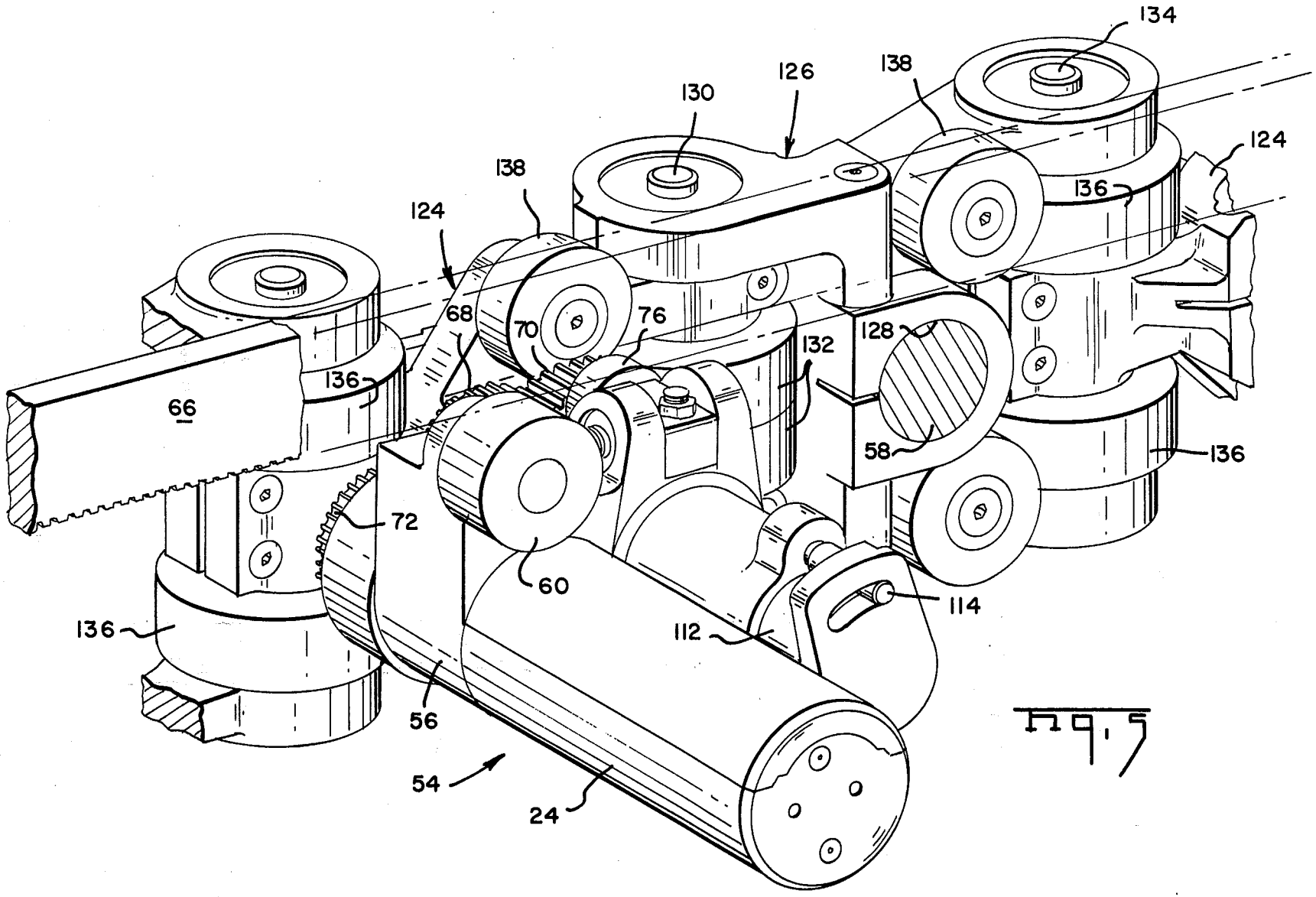
FIG. 5 is a trimetric drawing illustrating a section of the conveying chain with a mandrel assembly affixed thereto.

To provide proper registration, each can must be firmly gripped by its mandrel and all movement of the mandrel must be totally controlled. The mandrel must rotate as it passes over the printer and the rotational speed must equal that of the printing cylinder. The rotation and control of the mandrel is provided by a mandrel control unit 54 fixed to the chain and shown in trimetric in FIG. 5 and in cross-section in FIG. 9. The unit comprises a frame 56, a jack shaft 58, a gear train, a mandrel 24 and a control roller 60. The gear train comprises gears 68 and 70 on shaft 58 and gear 72 which meshes with gear 70. Shaft 58 is fixed at 62 to the conveyor 12. A spherical adjustment is provided in that joint to set the mandrel 24 in parallel relationship with the printing blanket 36.

Figure 10:
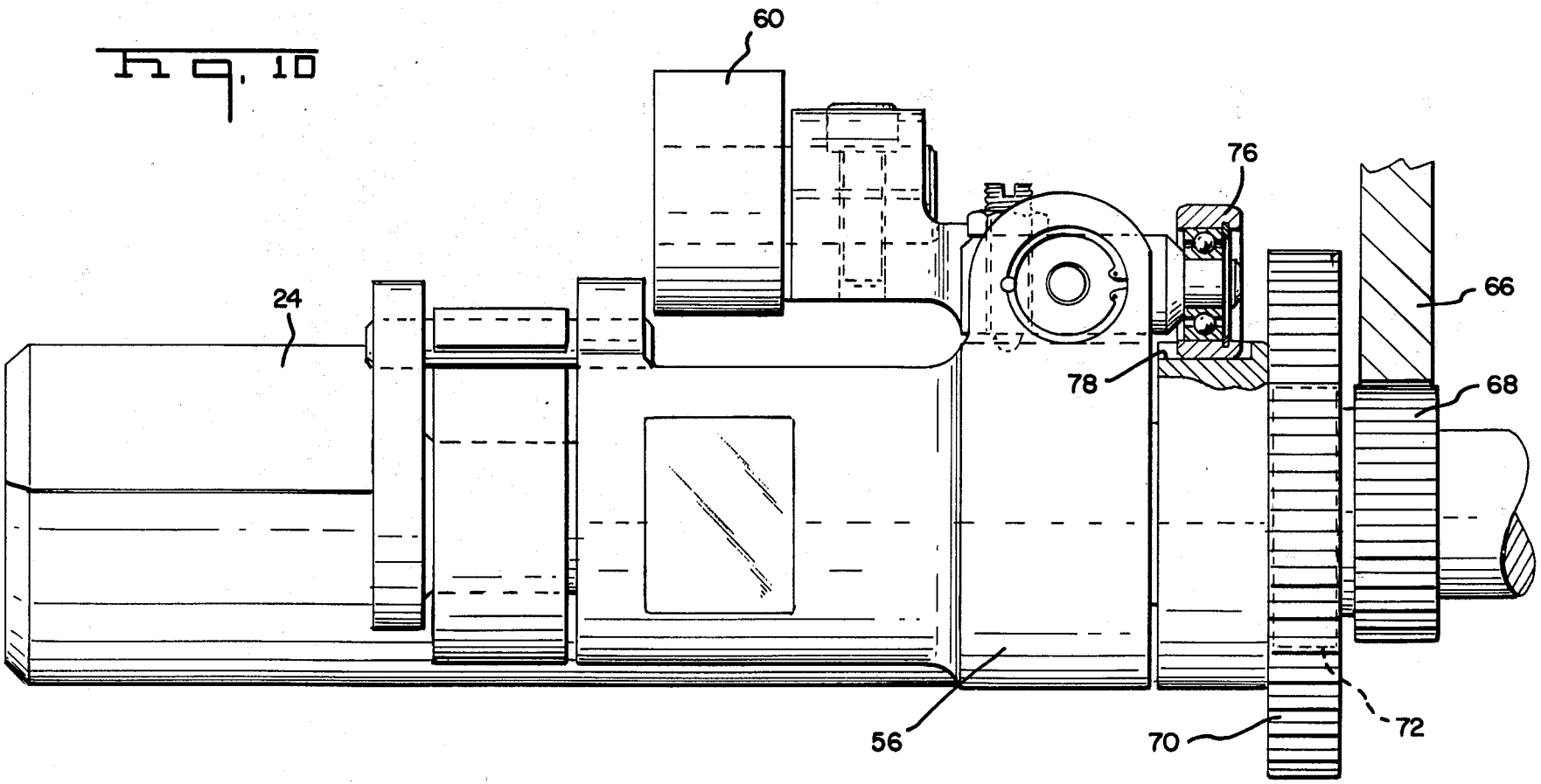
FIG. 10 is an elevation view of a typical mandrel assembly with parts broken away to disclose a detent mechanism.
Figure 11:
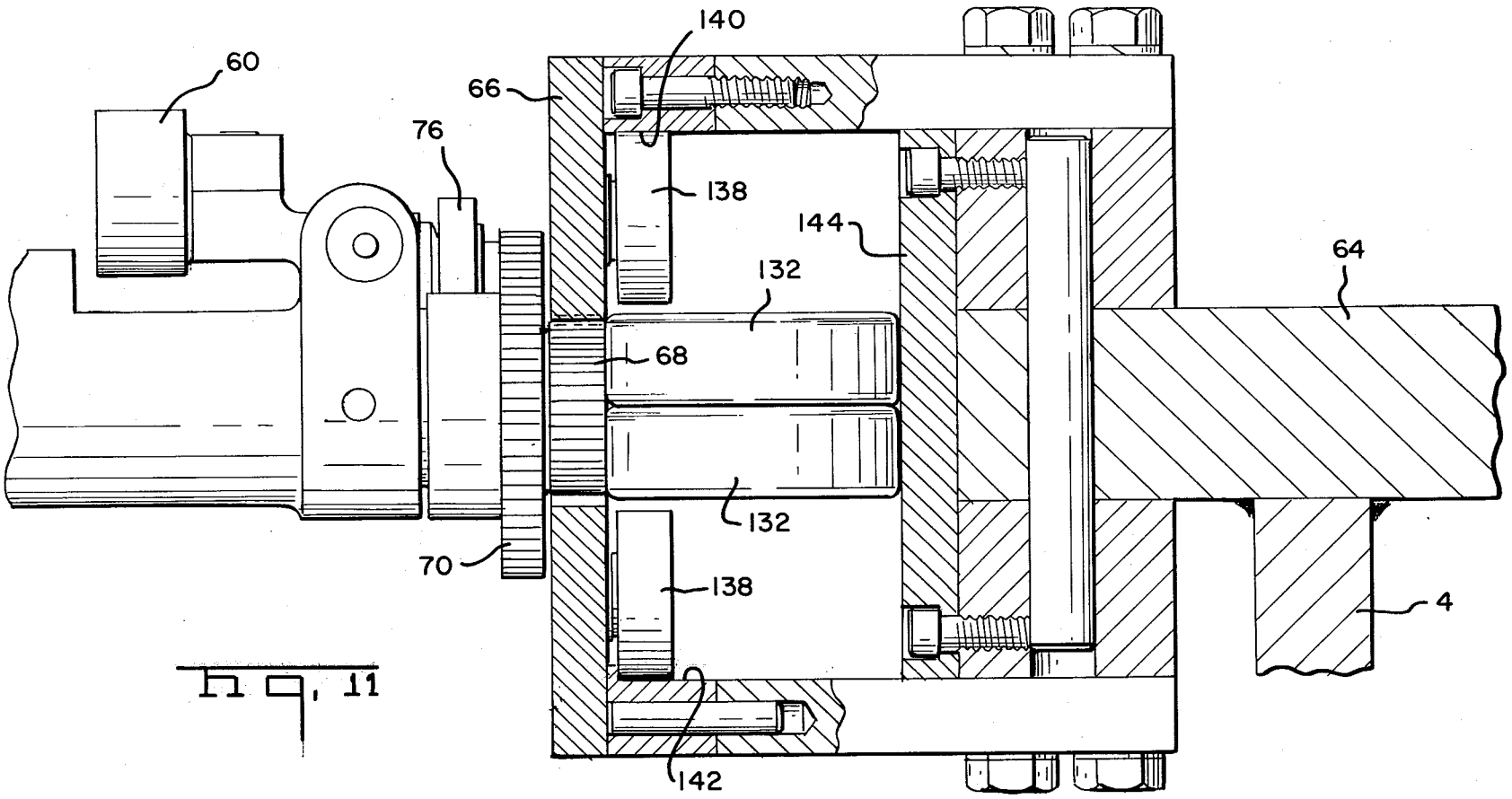
FIG. 11 is a view similar to FIG. 10 but showing the bearing means for the constant velocity chain.

Referring to FIGS. 10 and 11, a main support plate 64 fixed to frame 4 supports a track 144 for the chain rollers and a linear gear rack 66 to impart rotational movement to a small gear 68 fixed for rotation on shaft 58. Integral with gear 68 is a large gear 70 which mates with a small gear 72 fixed to the mandrel shaft. Gear 68 is driven at the same speed as the linear movement of the conveyor and the mandrel. Through the disclosed gear train, it is driven at a speed equal to that of the printing cylinder. In the event it is desired to mechanically connect the mandrel to the printing roller, the mass 74 on the mandrel may be machined with teeth to mesh with a mating gear on the printing roller.

The space between the printing stations is calculated on the basis of rack gear teeth so that, although the mandrels are spinning, it is a controlled spin and the mandrels will introduce the proper point on the can to the proper points on the printers as the can advances to each succeeding station.

As the mandrels and cans advance around the main drive shaft 52 and its associated sprocket, it is desired to stop the spinning action and to resume it again on the other side through a second rack. Since registration is still necessary, the spinning must be stopped at a precise point and be resumed at a precise point. This is accomplished by a detent mechanism 76 (FIG. 10) which is pivotally mounted in the frame 56 and which snaps in and out of a recess 78 in the collar of gear 68, 70. Recess 78 represents ZERO tooth position when detent 76 is engaged. Along the length of rack 66 the spring biasing detent 76 into recess 78 is overcome by the force of the relative movement of the rack and gear and continually pops in and out; however, just prior to advancing around shaft 52, the rack is ended as detent 76 engages gear 68, 70 and the gear is held in ZERO tooth position until it is picked up by the rack on the other side, thereby maintaining correct registration.

Figure 12:
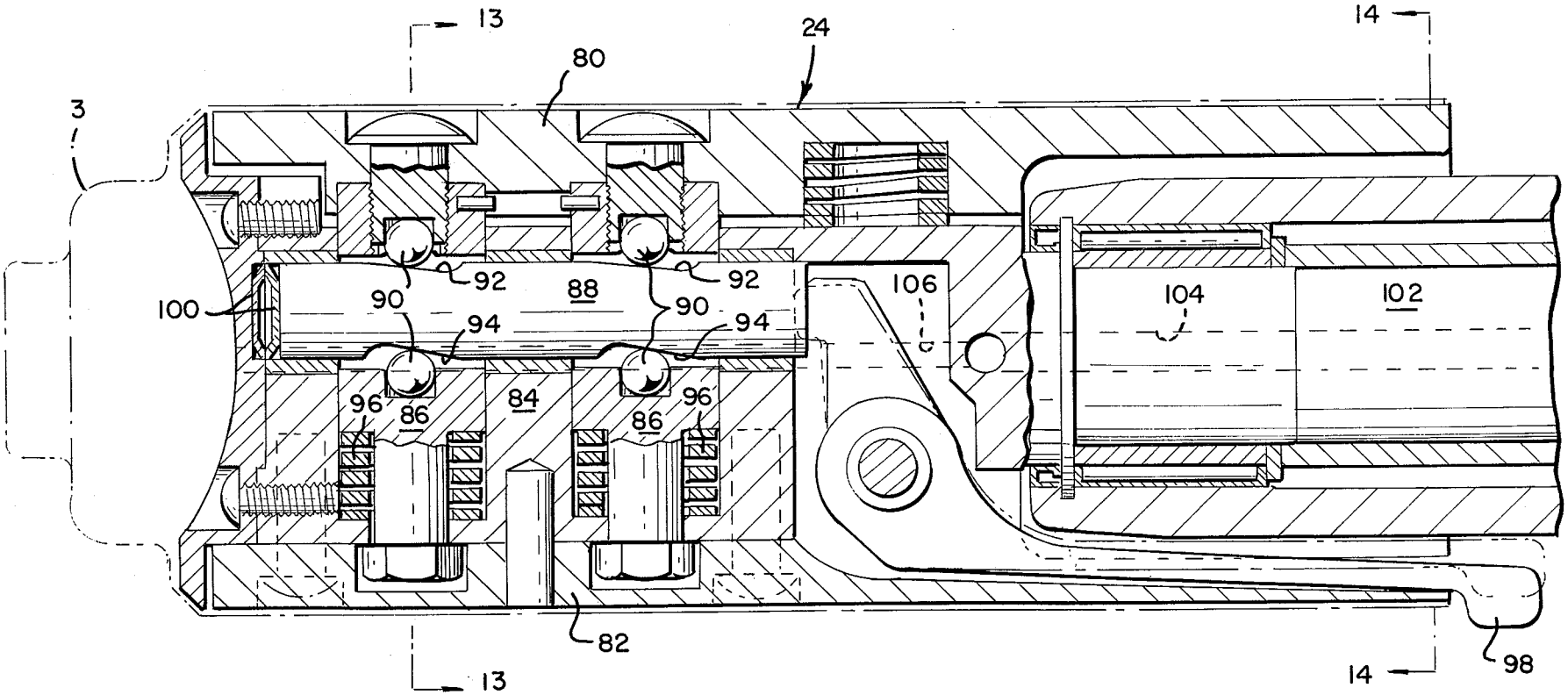
FIG. 12 is a cross sectional view through an expandible mandrel.

As mentioned earlier, each can 3 must be firmly gripped by its particular mandrel 24. This is accomplished by means of an expanding type mandrel. Any type would suffice, but for the purposes of disclosure, a particular embodiment is shown in FIGS. 12, 13 and 14. This mandrel comprises a two piece outer section 80, 82 joined together by an inner member 84, a pair of slides 86 and an actuating shaft 88. Slides 86 contain hardened balls 90 which cooperate with cam surfaces 92 and 94 on shaft 88 to either force the slides down in FIG. 12, to allow a can to be inserted or ejected, or to force the slides up through the bias of springs 96, to expand the mandrel for firm gripping of can 3. An external operating lever 98 is provided. This lever when acted upon by a properly placed infeed or discharge conveyor will cause movement of shaft 88, against the bias of a set of Bellville spring washers 100, to cause the mandrel to "shrink". When not being acted on by an external cam, the shaft 88 will be maintained in the "expanded" position through Bellville springs 100 and slide springs 96 to firmly grip the can 3 through the entire travel of the conveyor.

Figure 17:
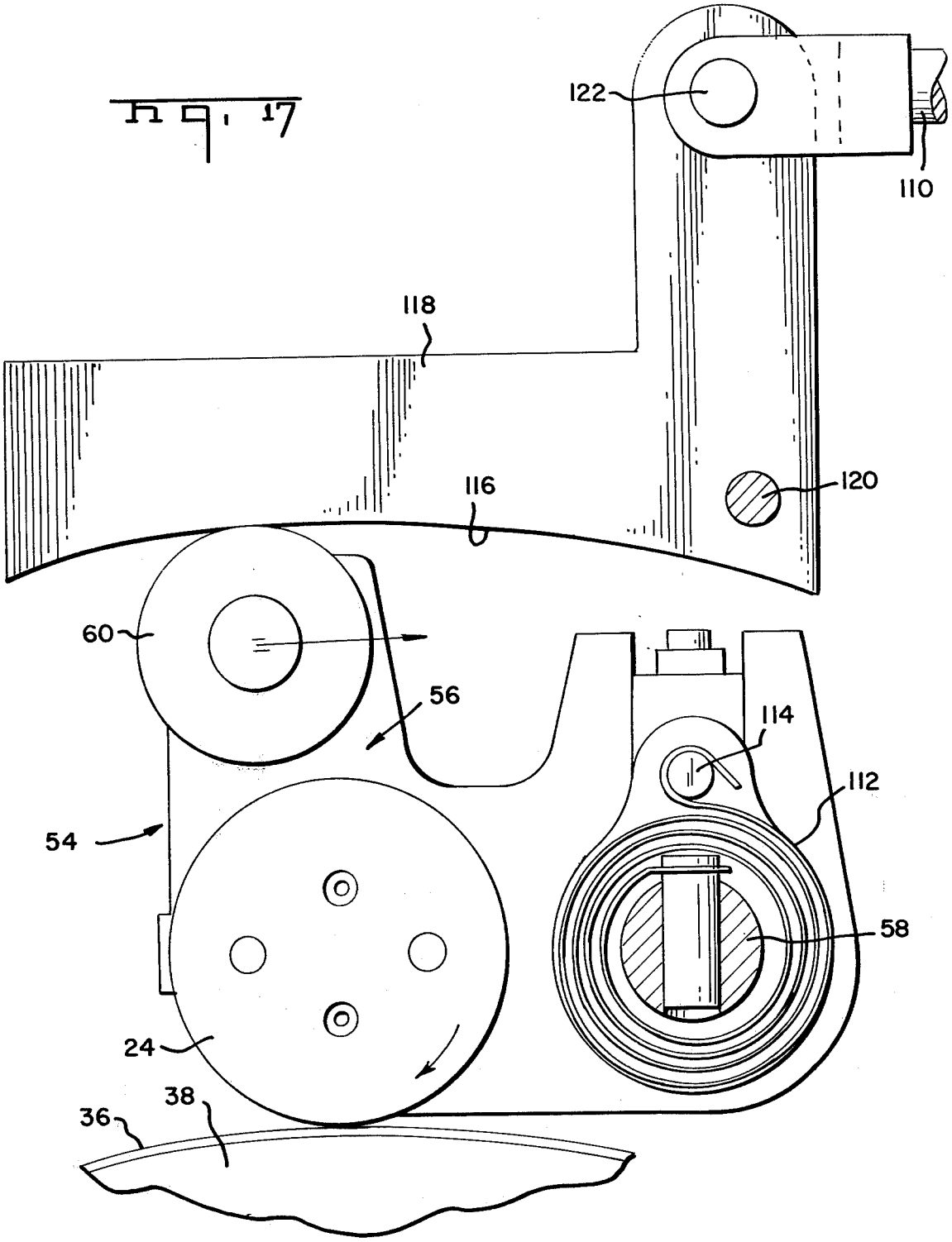
FIGS. 17 and 18 are orthographic views illustrating the "no can - no print" mechanism.
Figure 18:
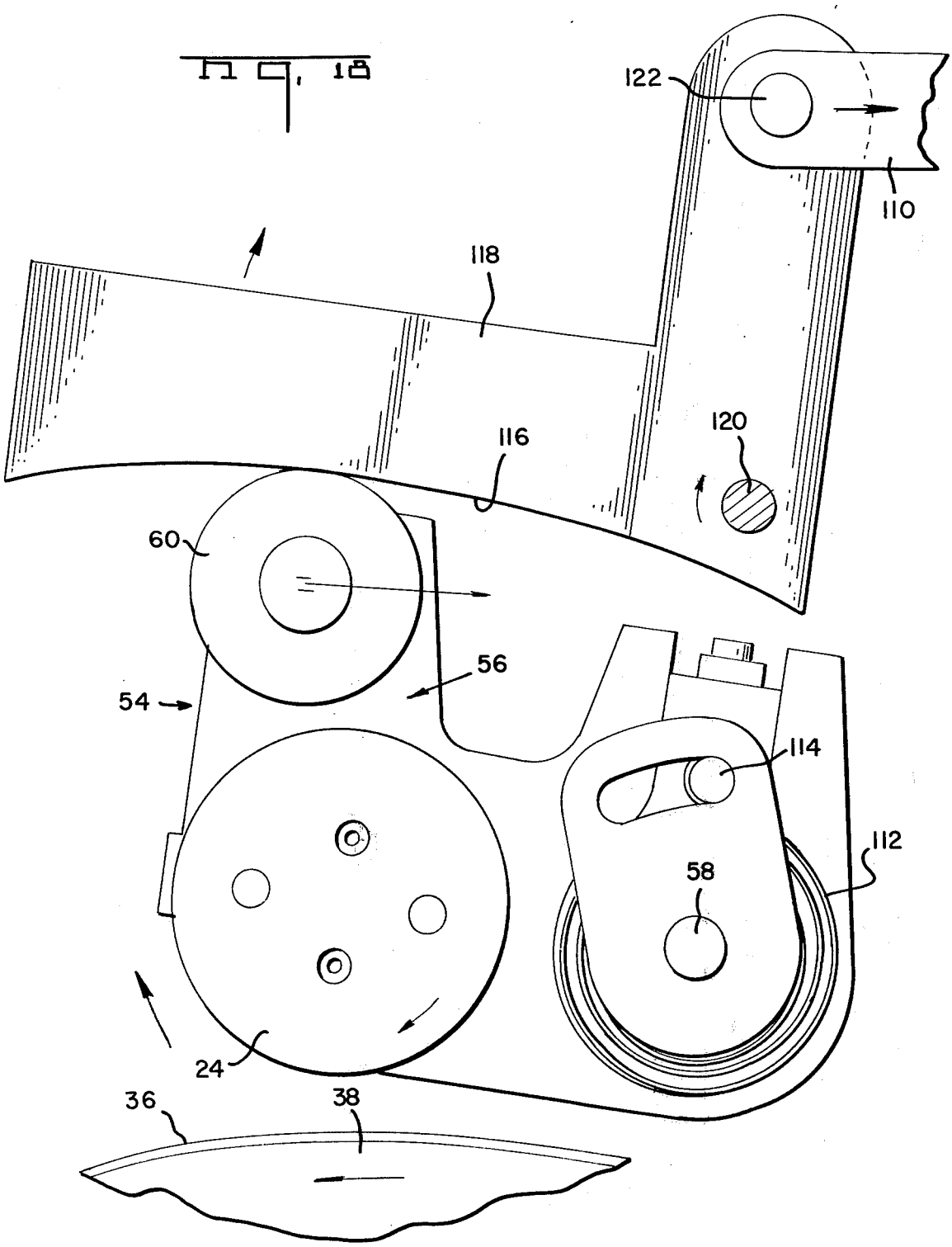

The mandrel shaft 102 is provided with an axial air hole 104 which then communicates with a pair of air holes 106 on the can side of the mandrel and an air blast supply on the other side. This air blast is utilized to eject the finished can on suction cups or magnetic pads at station 14 and also to eject any can that has not been properly placed on the mandrel before subsequent printing. A sensing mechanism signals the air blast if the can is not on all the way and the can is blasted off the mandrel. Since that mandrel then travels around the conveyor empty, a mechanism is provided at each printing station whereby a sensor 108 detects the presence of no can and triggers an air cylinder 110 to remove the mandrel from any contact with the printing blanket, thereby avoiding getting paint or ink on the mandrel itself. This is shown in FIGS. 17 and 18.

The previously described mandrel control unit 54 is biased in a clockwise direction about shaft 58 by a torsion spring 112, one end of which is fixed to the stationary shaft 58 and the other end to a pin 114 on the frame 56. In the print station, the mandrel is biased toward the print roller 38 by means of a cam surface 116 acting on the control roller 60. This cam surface is part of a bell crank 118 pivotally connected to the machine frame at 120 and to the piston rod of air cylinder 110 at 122. When the sensor 108 detects no can, it triggers cylinder 110 to rotate bell crank 118 to the position of FIG. 18, thereby allowing unit 54 to pivot clockwise under the influence of spring 112. As shown in FIG. 18, this motion removes the mandrel from contact with the printing wheel and the mandrel stays clean. A similar mechanism is provided at each printing station.

The precise registration required, even with the foregoing mechanism, would not be possible if the conveyor motion were dependent upon a standard type of line drive chain.

The common chain must, of necessity, be allowed a certain amount of slack for proper functioning and wear. Slack is always encountered in the relationship of chain link to sprocket and this inherent quality causes the chain to move in a somewhat jerky manner and definitely not with the accuracy required to maintain precise registration of every mandrel with every printer at all times.

Figure 6:
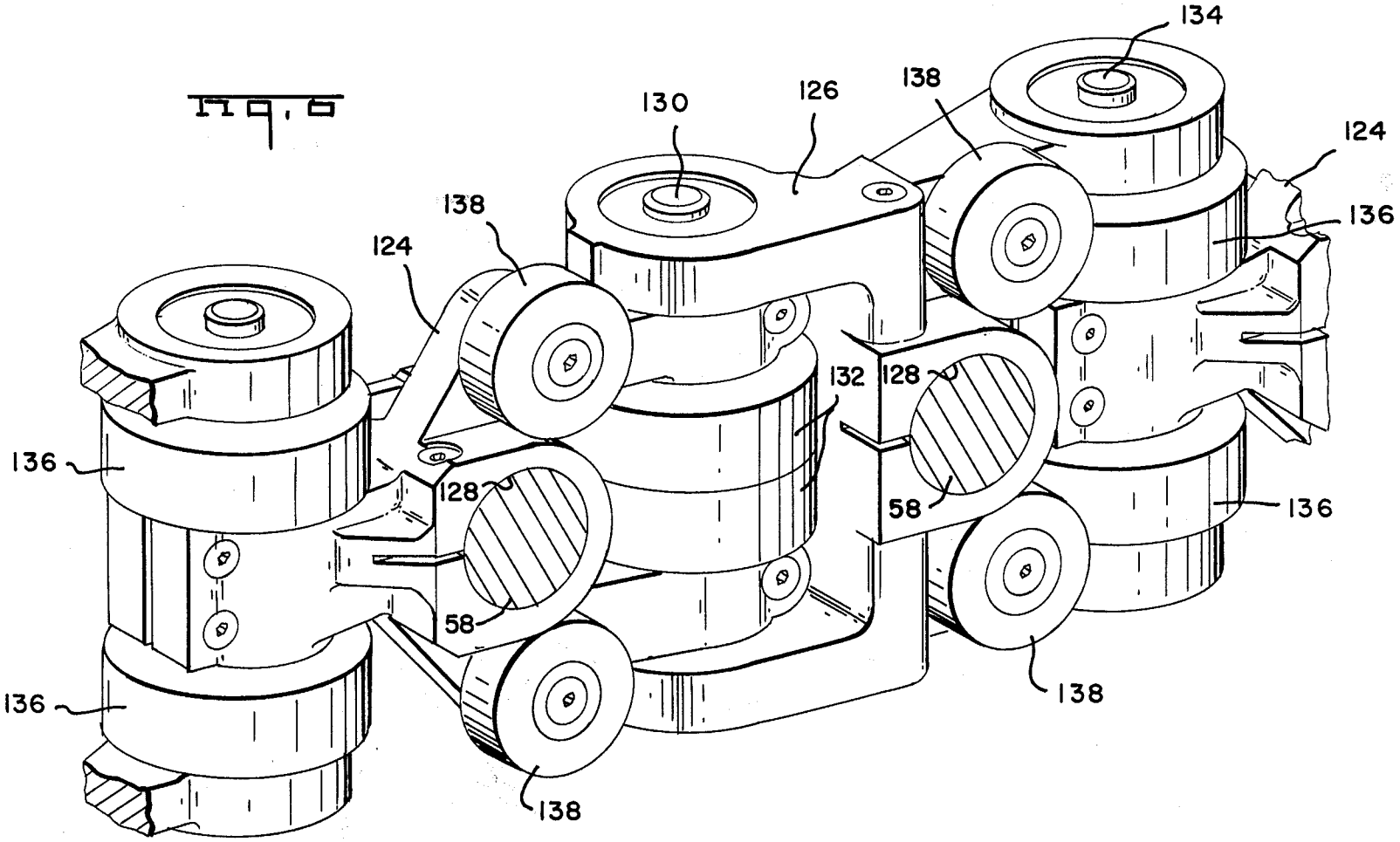
FIG. 6 is a view similar to FIG. 5 but showing only the chain components.
Figure 7:
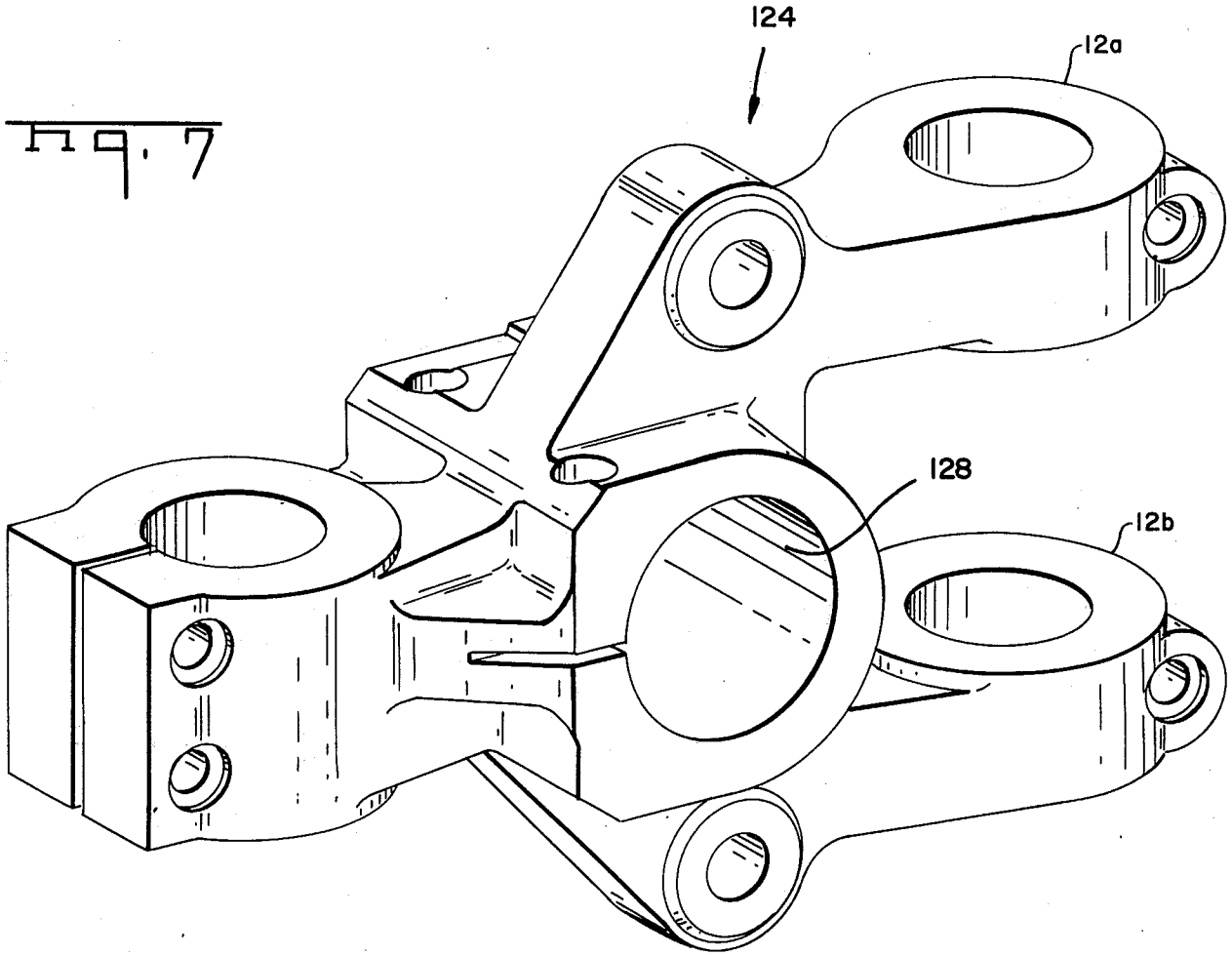
FIG. 7 is a trimetric view of the male link of the disclosed chain.
Figure 8:
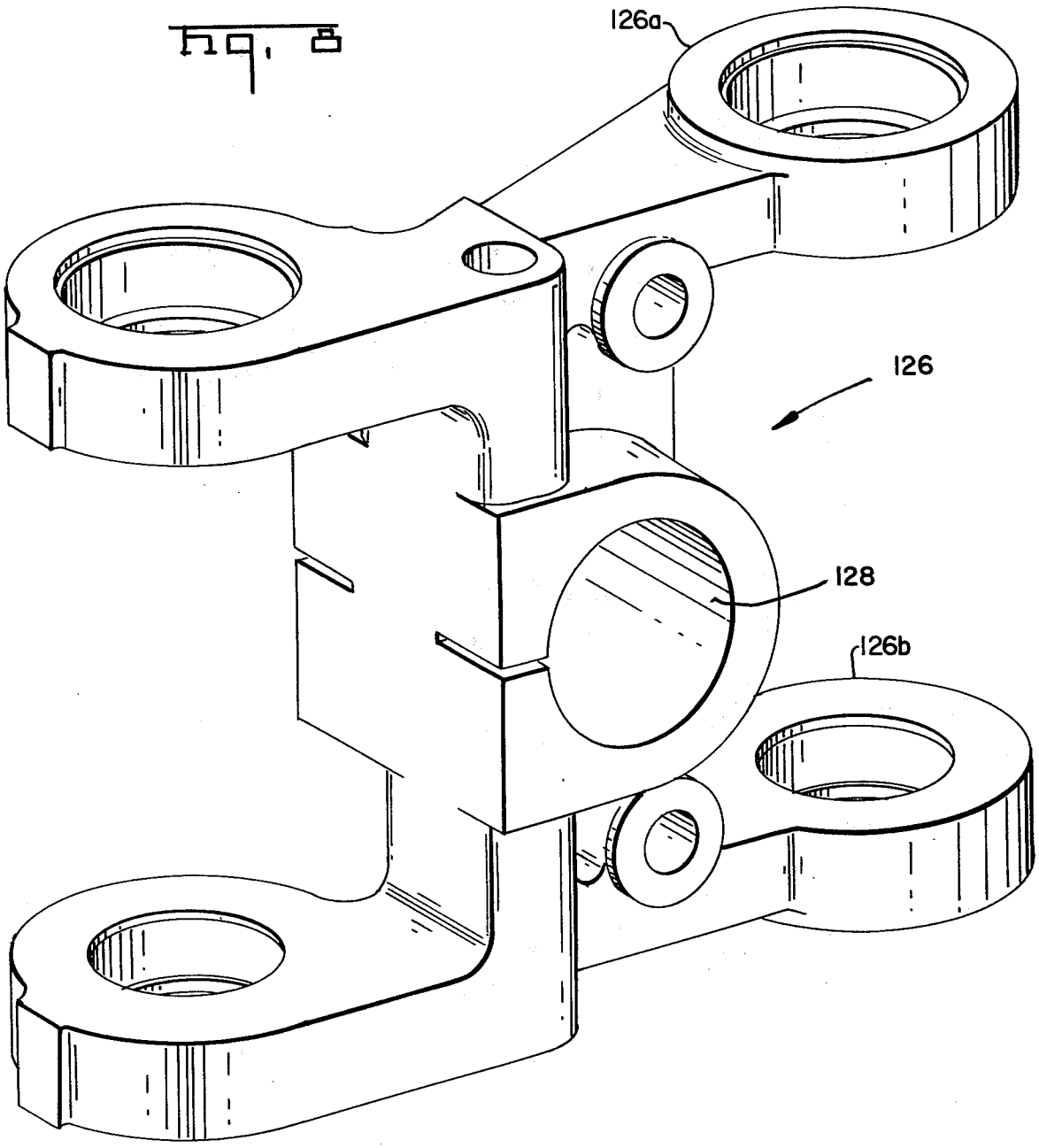
FIG. 8 is a trimetric drawing of the female link.
Figure 9:
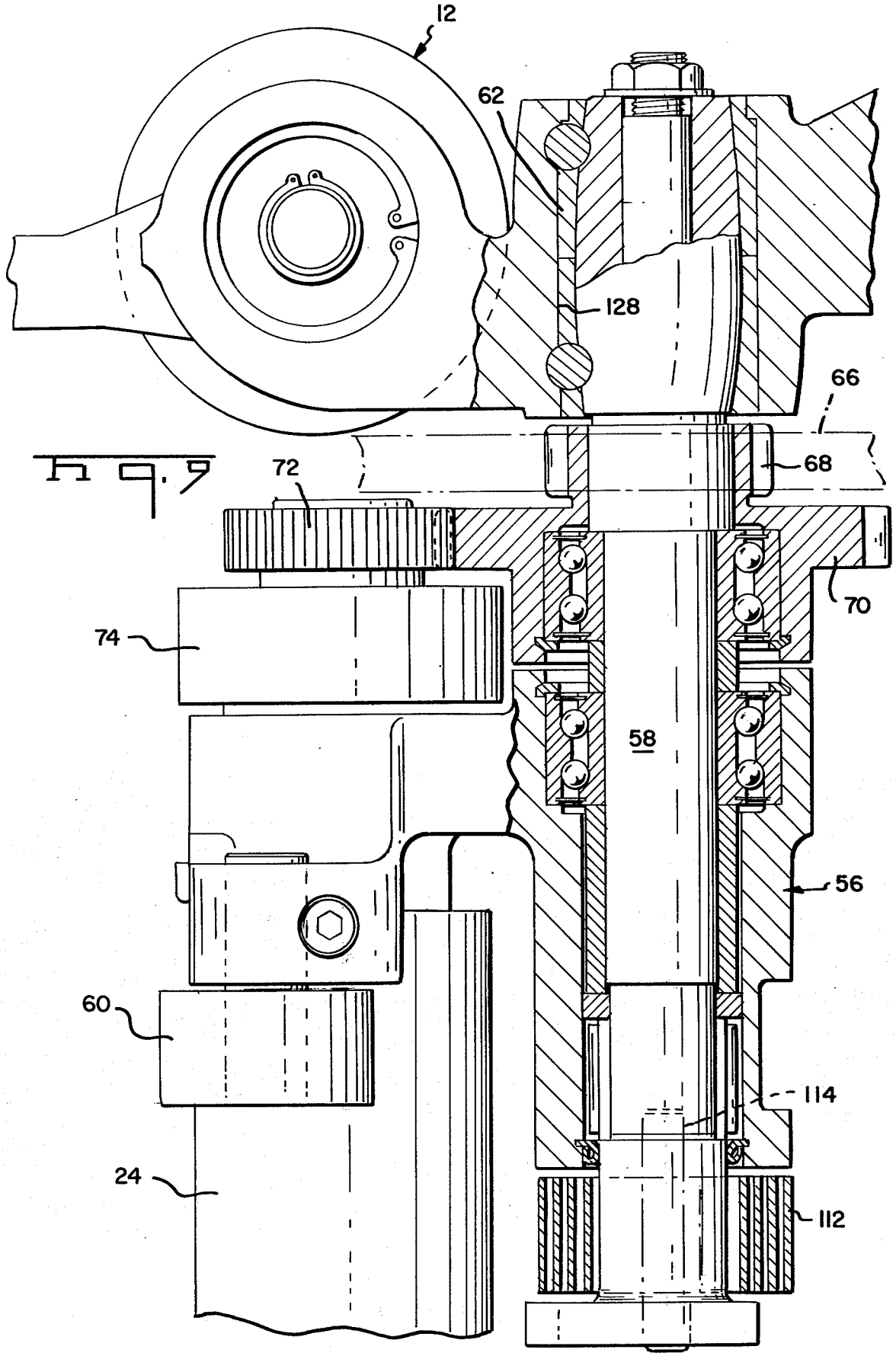
FIG. 9 is a fragmentary, partially sectioned view of the mandrel assembly showing its connection to the conveyor chain.

To eliminate this problem, a constant velocity chain is provided which contains no slack and which moves uniformly with total accuracy. Each section of this chain is made up of a male link 124 (FIG. 7), a female link 126 (FIG. 8) and a plurality of ball bearing rollers. Each link has rounded portions 12*a*, 12*b*, on the male link and 126*a*, 126*b* on the female link. Both links 124, 126 are provided with a mounting hole 128 to receive a shaft 58 on each mandrel unit 54 (FIG. 9). The interconnection of the associated chain components is shown in FIG. 6. A pin 130 extends through holes in the rounded portions of each link and through matching holes in compensating rollers 132. A pin 134 extends through holes in the rounded portions of male link 124 and through matching holes in a second pair of compensating rollers 136. A pair of vertically disposed guide rollers 138 is also fixed to each link, male and female.

Figure 15:
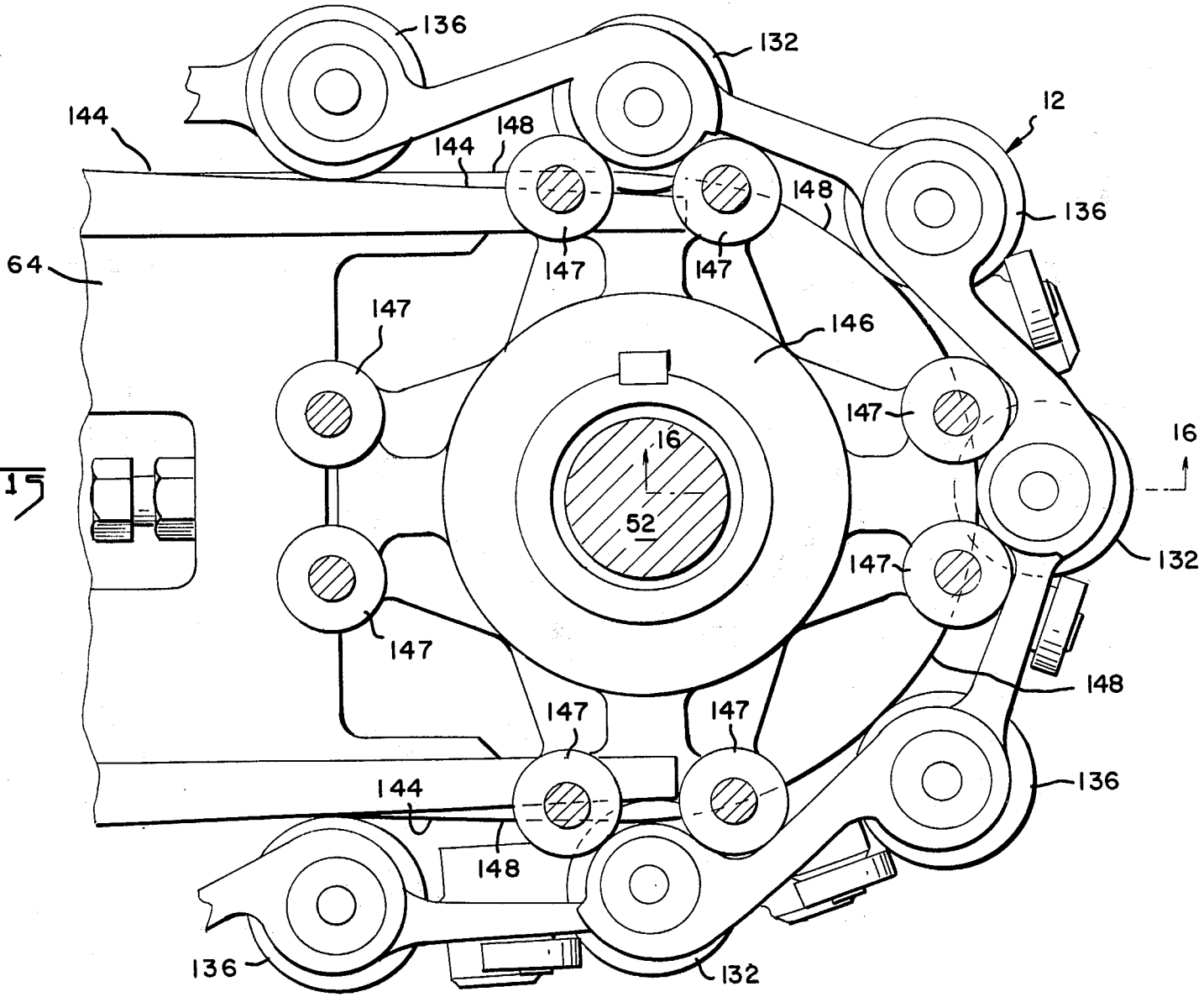
FIG. 15 is a top plan view of the constant velocity chain and its associated structure.
Figure 16:
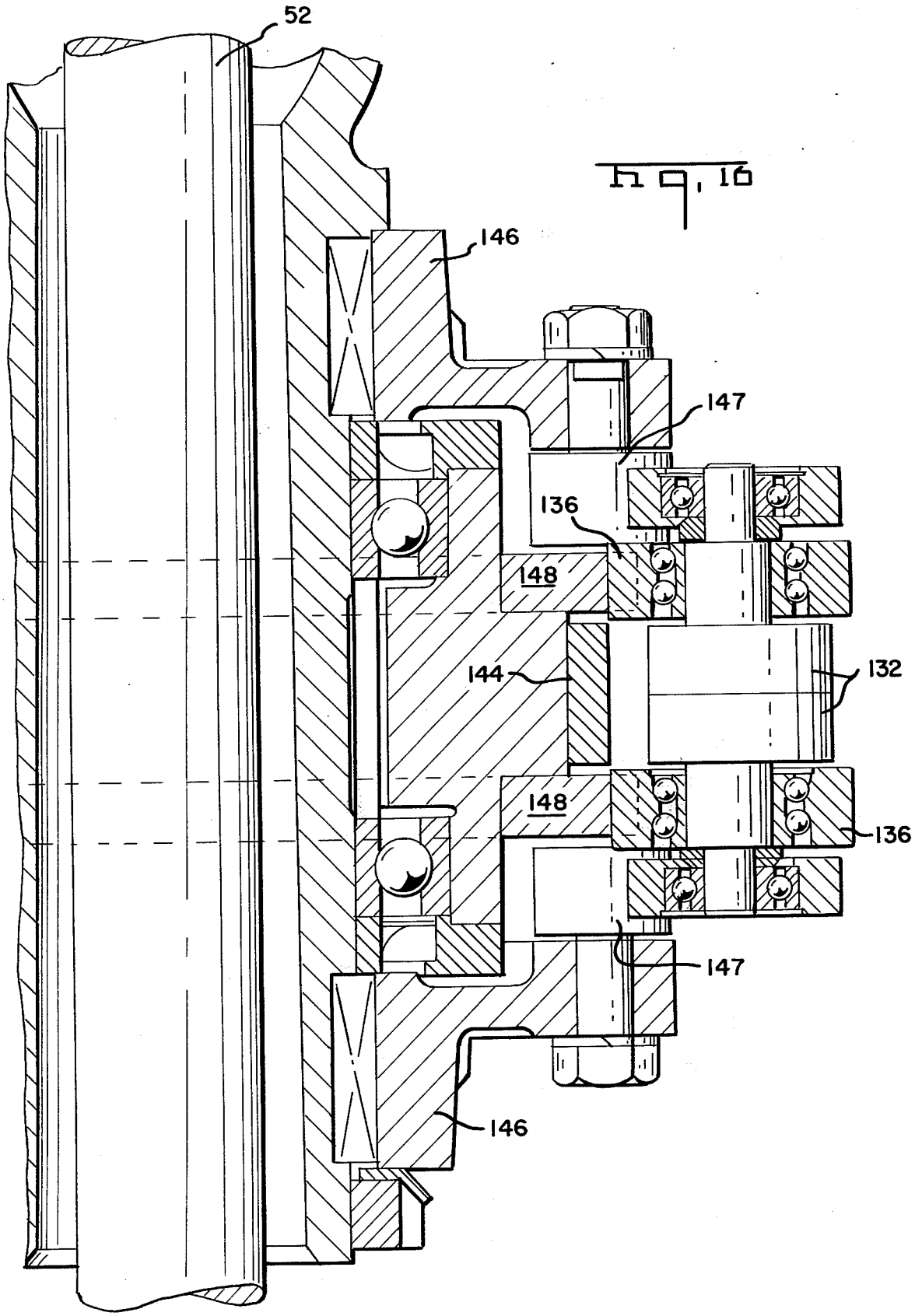
FIG. 16 is a view taken along the lines 16—16 of FIG. 15.

The action of rollers 138 can be seen in FIG. 11 where they are shown riding on an upper bearing plate 140 and a lower bearing plate 142 to stabilize the chain as it moves along its straight path. In this same view, compensating rollers 132 can be seen bearing against a cam track 144. As the linear section of chain travel gives way to the circular sprocket 146, and its associated drive rollers 147, the compensating rollers 132 leave the cam track 144 which also comes to an end as seen in FIG. 15. Merging with that cam track in a spaced apart relationship is a pair of calculated compensating curved tracks 148 which cooperate with rollers 136 to eliminate all slack as the chain travels its circular path around the sprocket. This is accomplished by forcing rollers 136 outwardly to make the combined length of A to B and B to C (FIG. 15) always equal to the normal straight line dimension of A to C when the chain is traveling a straight path. In this manner, the articulations bearing rollers 136 follow a different, longer path to effectively compensate for the progressive angular displacement of the other ones of the articulations. The constant velocity thus achieved prevents slack in the chain of conveyor links.

This compensating factor provides for a slackless chain and thereby a constant velocity chain which travels with the necessary accuracy to permit precise registration of mandrel to printer.

In operation, the cans 3 are fed onto the mandrels 24, are constantly rotated at equal speed and in constant time with a plurality of printers 8, are dried between printings and finally are ejected at station 14 by a first air blast similar to that used to eject a badly positioned can, and then by suction means at successive stages of station 14. When the conveyor stops, the ink fountains continue to rotate slowly to prevent drying of the ink. When the conveyor stops, the mandrels automatically are moved to the no-print condition.

An advantage of this type of printer is that it can easily be modified to print two cans at a time, thereby greatly increasing capacity. Also, while a horizontal arrangement has been shown, it is possible to orient the conveyor chain at a 90° angle from that shown, thereby providing a vertical arrangement.

Although a specific embodiment of the invention has been shown and described, it will be understood that various modifications may be made without departing from the true spirit and scope of the invention as set forth in the appended claims.

What is claimed is:

1. Apparatus for printing on cans and similar cylindrical objects comprising:

a conveyor for transporting said cylindrical objects between a feed station and a discharge station, said conveyor having linear and curved portions and comprising a plurality of rigid links coupled to one another by articulations;

sprocket means disposed at at least one of said curved portions and including means for engaging ones of said links adjacent first ones of said articulations to urge said conveyor along a predetermined path;

a stationary curved track disposed proximately to said sprocket means for engaging ones of said links adjacent second ones of said articulations to cause the latter articulations to follow a path different from the path of said first ones of said articulations, whereby the velocity of said conveyor is rendered substantially constant;

a plurality of mandrels carried by ones of said links of said conveyor, each mandrel fitting inside one of said cylindrical objects to hold it during travel between said feed and discharge stations; and a plurality of printers spaced longitudinally along a linear section of said conveyor, ones of said printers contacting said cylindrical objects as they pass for sequentially printing at least two interrelated patterns to form a design thereon.

2. The apparatus recited in claim 1 wherein said conveyor comprises at least two linear portions, and wherein said track extends at least partially about said sprocket means, said apparatus further including:

compensating rollers disposed at said second ones of said articulations for engaging and following said curved track to urge said second ones of said articulations radially outwardly as said links traverse a curved portion of said conveyor.

3. The apparatus recited in claim 2 wherein said links and said compensating rollers have matching holes therethrough, and a pin extending vertically through holes in adjoining links and through said rollers.

4. The apparatus recited in claim 2 wherein said links have a horizontally disposed opening for mounting one of said mandrels.

5. The apparatus recited in claim 4 further comprising:

at least one guide roller on each link, said guide rollers being vertically disposed, and a cam track along each linear section of said conveyor, said guide rollers riding in said cam track.

6. The apparatus recited in claim 2 wherein said sprocket has a plurality of drive rollers disposed around said sprocket, each of said links having a round portion, said drive rollers cooperating with said round portions to drive said chain around said sprocket.

7. The apparatus recited in claim 1 wherein each printer includes a rotating printing cylinder and an ink fountain for said cylinder.

8. The apparatus recited in claim 7 further comprising:

means for rotating said printing cylinders, and means for rotating said mandrels in synchronism with the rotation of said cylinders whereby correct registration of a printing pattern on said objects in achieved without slippage between said cylinder and said object which would otherwise cause smudging of said pattern.

9. The apparatus recited in claim 8 wherein said means for rotating said mandrels comprises:

a linear rack along said conveyor, a plurality of mandrel frames mounted on said conveyor, gear means rotatably mounted in each of said frames and engaging said rack, said gear means being connected to each mandrel to rotate it.

10. The apparatus recited in claim 9 wherein said conveyor is driven by a sprocket disposed between two linear sections of said conveyor, said rack extending only along said linear sections of said conveyor, said apparatus further comprising:

a spring loaded detent pivotally mounted on said frame, said detent engaging and disengaging a recess in said gear means when said rack is rotating said gears means, said detent engaging said recess to hold said gear means in a zero position during travel around said sprocket.

11. The apparatus recited in claim 9 wherein said mandrel frame is rotatably mounted with a spring bias on said conveyor, a control roller mounted on said mandrel frame, a crank member having a cam surface pivotally mounted at each printing station, said cam surface normally acting upon said control roller to force the object on the rotating mandrel into contact with the rotating printing cylinder, means for sensing the absence of a can on a mandrel, and means for rotating said crank member in response to the detection of no can whereby the spring bias on said mandrel frame rotates said mandrel out of contact with said printing cylinder.

12. The apparatus recited in claim 8 wherein said means for rotating said mandrels rotates said cylindrical objects continuously between printing stations tending to dry the printed pattern between printing stations.

13. The apparatus recited in claim 8 wherein said mandrels are rotated at the same velocity as said printing cylinders.

14. The apparatus recited in claim 8 further comprising:

a sprocket disposed between two linear sections of said conveyor for driving said conveyor, a linear rack along the linear sections of said conveyor, a plurality of mandrel frames mounted on said conveyor, gear means rotatably mounted in said frames and engaging said rack, said gear means being connected to each mandrel to rotate it as said conveyor moves it linearly, a motor driving said sprocket, and transmission means connecting said motor to said printing cylinders so that they are rotated in synchronism with the rotation of said mandrels.

15. The apparatus recited in claim 1 wherein each of said mandrels is expandible into gripping relationship with said objects.

16. The apparatus recited in claim 1 wherein each of said printing mechanisms can be easily engaged with and disengaged from said conveyor.

17. The apparatus recited in claim 16 wherein each of said printers has wheels and cooperating tracks which enable each printing mechanism to be easily engaged with and disengaged from said conveyor.

* * * * *